US007717450B2

(12) United States Patent
Amiri

(10) Patent No.: US 7,717,450 B2
(45) Date of Patent: May 18, 2010

(54) WHEELCHAIR LUGGAGE TOWING DEVICE

(76) Inventor: Shiva Amiri, 20 Bridewell Cres., Richmond Hill, Ontario (CA) L4C 9C4

( * ) Notice: Subject to any disclaimer, the term of this patent is extended or adjusted under 35 U.S.C. 154(b) by 313 days.

(21) Appl. No.: 11/723,043

(22) Filed: Mar. 16, 2007

(65) Prior Publication Data

US 2007/0222180 A1 Sep. 27, 2007

Related U.S. Application Data

(60) Provisional application No. 60/786,103, filed on Mar. 27, 2006.

(51) Int. Cl.
*A61G 5/10* (2006.01)

(52) U.S. Cl. ..... 280/304.1; 224/401

(58) Field of Classification Search ..... 280/304.1; 224/401

See application file for complete search history.

(56) References Cited

U.S. PATENT DOCUMENTS 3,497,259 A * 2/1970 Sherfey ..... 297/391
3,730,589 A * 5/1973 Lane ..... 297/391
4,611,819 A 9/1986 Glasford
4,902,029 A 2/1990 Gain
5,769,440 A * 6/1998 Jones ..... 280/204
5,967,613 A * 10/1999 McKeever ..... 297/397
6,231,016 B1 * 5/2001 Slone ..... 248/200.1
7,207,630 B1 * 4/2007 Reynolds ..... 297/397

* cited by examiner

*Primary Examiner*—Kevin Hurley
(74) *Attorney, Agent, or Firm*—Nasser Ashgriz

(57) ABSTRACT

A wheelchair luggage towing device to securely attach a luggage to the back of a wheelchair and pull the luggage along with the wheelchair. The device can be used with wheeled, as well as unwheeled luggage using a wheeled luggage carrier. The device comprises of a single or multiplicity of bars. A single bar is used with wheelchairs which have long vertical bars on their back. Two bars are used with wheelchairs which have a horizontal bar at their upper back. And three bars are used with wheelchairs which have two short vertical bars and no horizontal bar. In this case, a first bar is connected horizontally to the vertical bars of the wheelchair. A second bar is connected vertically to the first bar. And a third bar is connected horizontally to the lower end of the second bar. In all cases, the luggage is secured on the horizontal bar located close to the ground.

6 Claims, 7 Drawing Sheets

(a)

(b)

(a)

(b)

WHEELCHAIR LUGGAGE TOWING DEVICE

This application claims the benefit of U.S. Provisional Application No. 60/786,103 Filed Mar. 27, 2006

BACKGROUND

1. Field of Application

It is difficult for disabled persons to carry luggage along with their wheelchair while moving from place to place, be it in airport terminals, in and out of hospitals, nursing homes, etc. Travel is extremely difficult as usually an assistant is required to help move the luggage of the disabled traveller. The luggage of the disabled traveller is handled separately, the traveller cannot move the wheelchair and their luggage together, without the help of another person. This creates dependence on another individual in cases of travel or even simpler day-to-day activities such as going to the hospital, shopping, etc. and thus hinders the disabled individual from carrying out certain activities. Our invention takes out the dependence on another individual so that the disabled wheelchair user can gain a great deal of independence by moving their own luggage along with their wheelchair. This is most convenient at airports where the wheelchair user no longer needs to depend on airport staff to handle their luggage and they can be in charge of it themselves.

2. Description of the Related Art

Other inventions have put the luggage in a large carrier (U.S. Pat. No. 4,902,029), this makes it inconvenient and difficult to use for a disabled person as the carrier needs to be carried somehow itself before it can carry the luggage. Another invention has put the luggage on the side of the wheelchair (U.S. Pat. No. 4,611,819). This can result in difficulty during turning and throw off the balance of the wheelchair. Also the attachment is very complicated and difficult to use, as is the carrier mentioned before.

DETAILED DESCRIPTION OF THE INVENTION

A method and a device for towing a luggage with a wheelchair is described. The method comprises of connecting the luggage to the back of the wheelchair. If the luggage has wheels, it can roll on the ground. If it does not have wheels, it can be put on a luggage towing carriage, and the carriage is then connected to the wheelchair.

Figure 1:
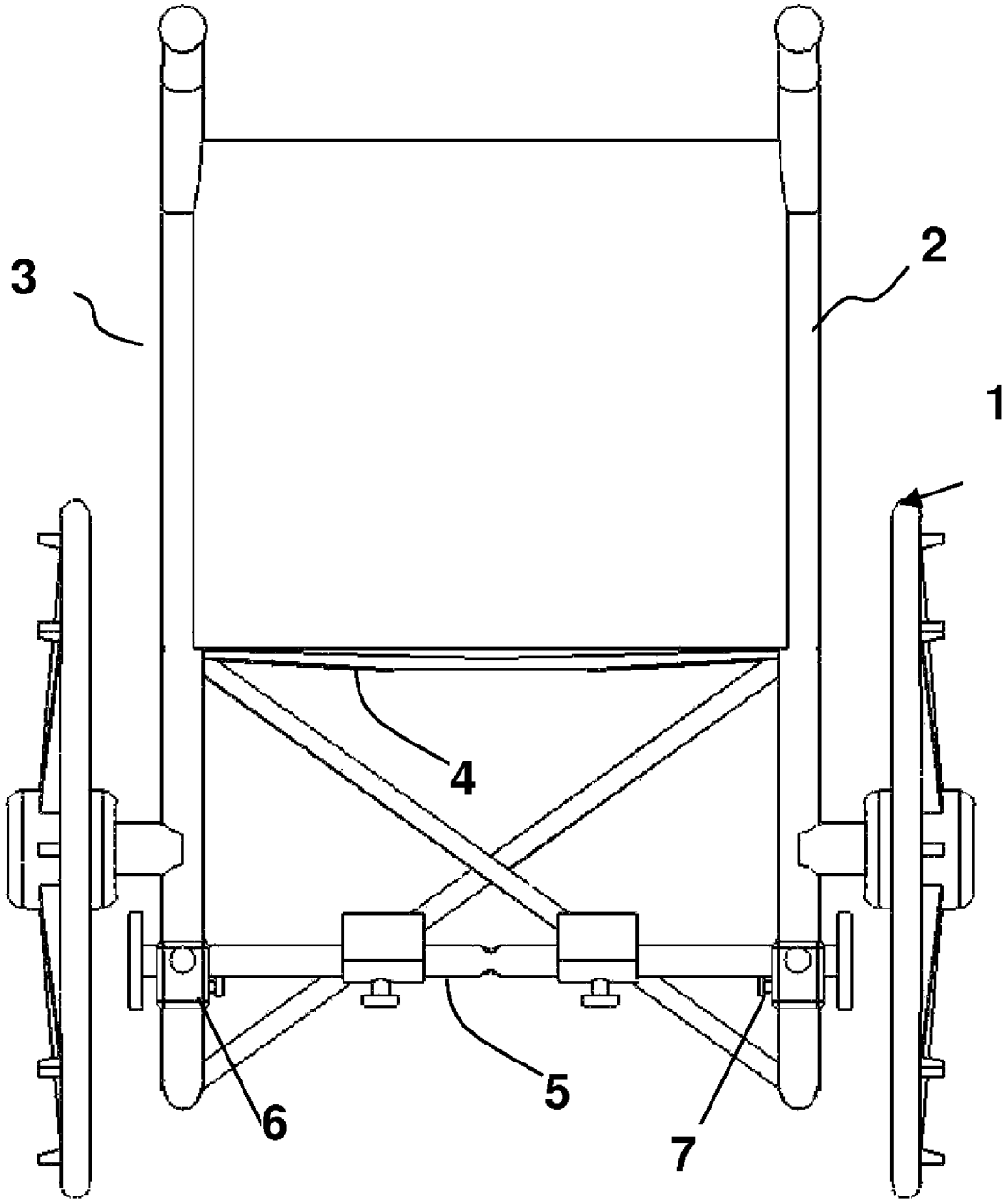
FIG. 1 A wheelchair luggage towing device attached to the vertical bars at the back of a wheelchair.

A wheelchair 1 typically consists of two vertical bars, 2 and 3, a foldable chair 4 and several horizontal bars at its back to provide stability and support. In order to carry a luggage along with a wheelchair, a horizontal bar 5 is attached (if one does not already exist) to the two vertical bars 2 and 3 at the back of the wheelchair 1 (all wheelchairs have two vertical bars) using rod clamps 6 and 7 or any other attachment means, as illustrated in FIG. 1.

Figure 2:
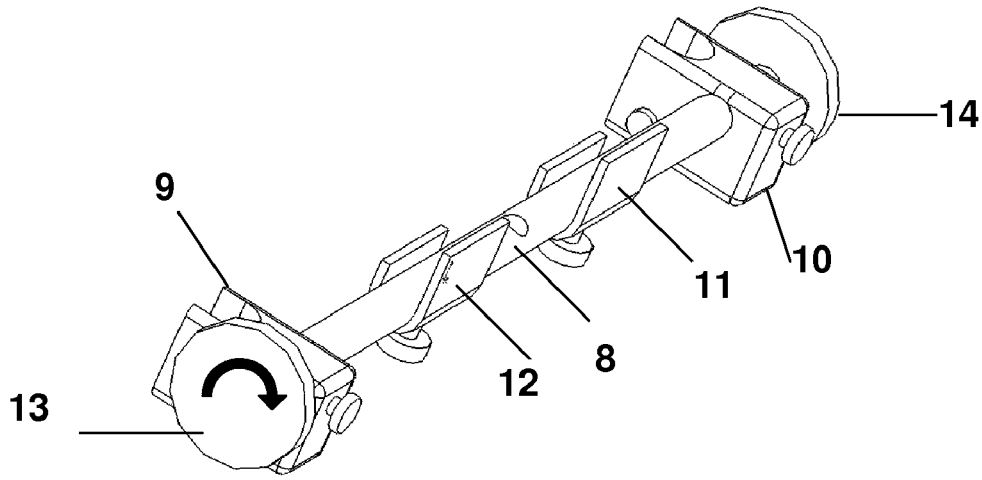
FIG. 2 A wheelchair luggage towing device having attaching means, luggage receiving means, and luggage releasing means.

FIG. 2 shows the present device for wheelchairs which do not have a low lying horizontal bar. This device comprises of a low-lying horizontal bar 8 having rod clamps 9 and 10 or any other attaching means to attach to the vertical bars of a wheelchair. The horizontal bar 8 also has at least two adjustable sockets 11, and 12 to set the luggage on. A socket is a U shaped piece which receives a bar and its sides are long enough to extend beyond the bar. Therefore, the wheels of a luggage can be set between the sides of the U shaped socket. Any other means to receive a luggage can be used. For instance, a set of clamps can be put on the horizontal bar to clamp a luggage or a luggage carrier to the horizontal bar. A luggage carrier is used for luggage which do not have wheels. Therefore, the wheels of the luggage fit into sockets 11 and 12 on the horizontal bar or they can be locked or held by any other previously disclosed receiving means on the horizontal bar. The horizontal bar also has means for turning the bar, such as knobs 13 and 14 so that it can release the luggage when needed.

Figure 3:
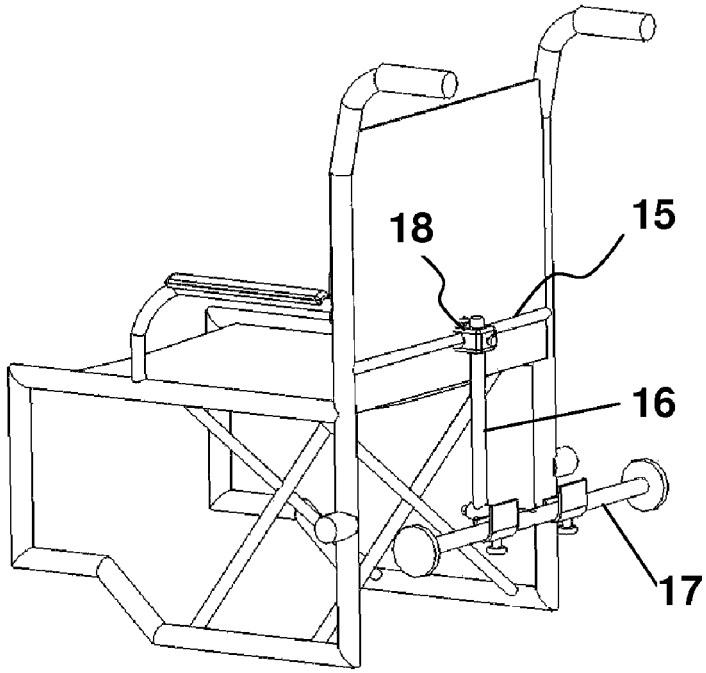
FIG. 3 A device for wheelchairs with a horizontal bar locating too high to set the luggage on. An adjustable vertical bar is used to adjust the height of the horizontal bar from the ground on which the luggage is set on. (*a*) Method of connection of the wheelchair, (*b*) device itself.
Figure 3:
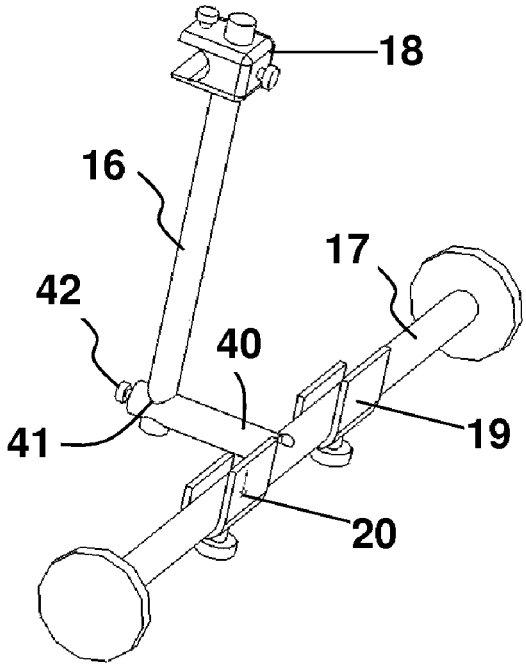

FIG. 3 illustrates the present device for wheelchairs which only have a high horizontal bar 15. In this case, the device comprises of an adjustable vertical bar 16, connected to a horizontal bar 17. Then, the vertical bar 16 is attached onto the existing horizontal bar 15, of a wheelchair, using a rod clamp 18 or similar attaching means, as shown in FIG. 3. This will ensure that the luggage is pulled at a low enough height from the ground so that wheelchair does not flip backwards. FIG. 3*b* shows the device and its rod clamp to connect to the horizontal bar 18 and its suckets 19 and 20. The adjustment of the height of the vertical bar is made by connecting the vertical bar 16 to the horizontal bar 17 through a small connecting rod 40. The connecting rod 40 has an aperture 41 that the vertical rod 16 goes through and a set screw 42 to fix the height. Any other adjustable means can also be used.

Figure 4:
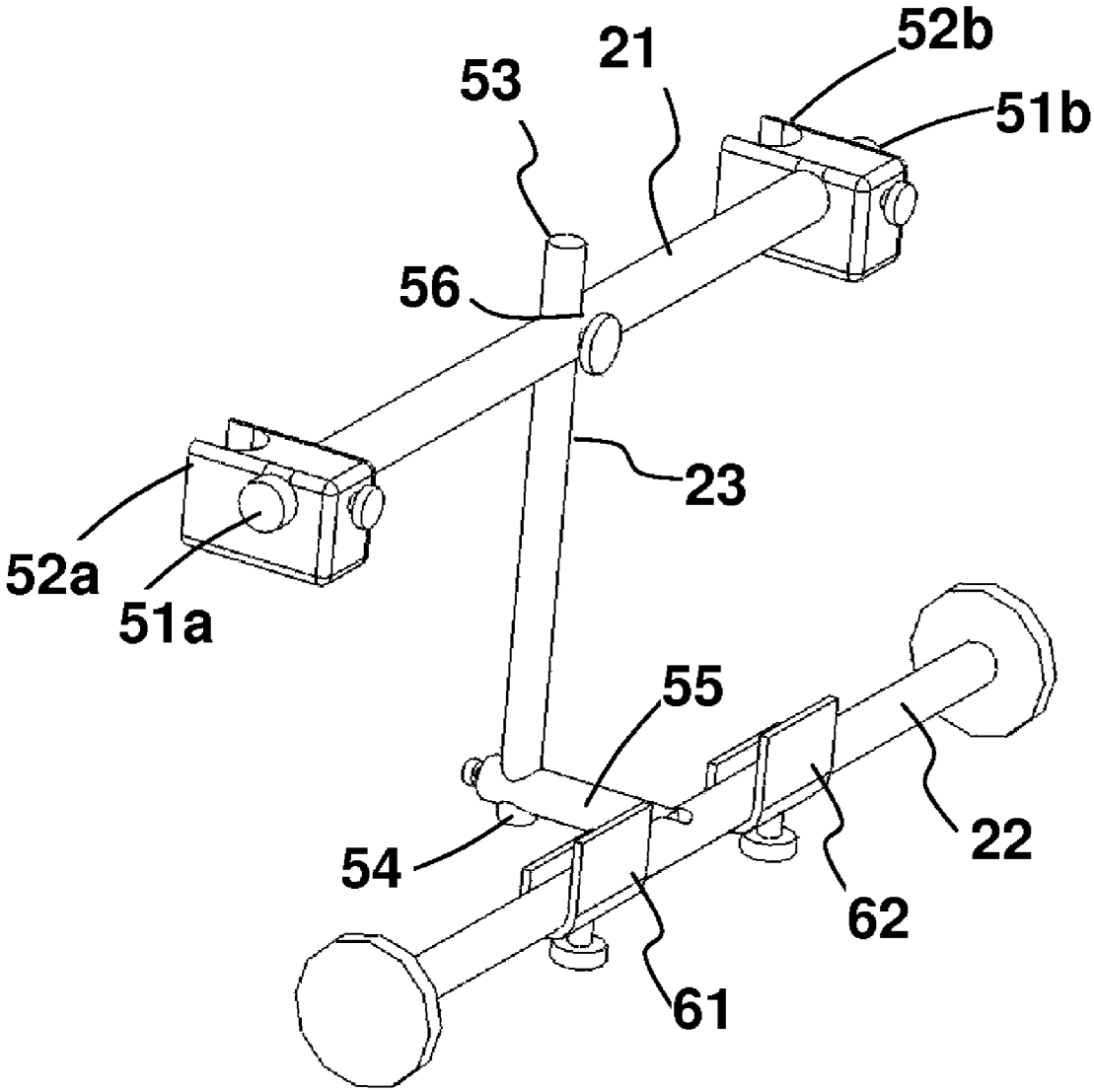
FIG. 4 A device for wheelchairs with short vertical bars at the back of the wheelchair.
Figure 5:
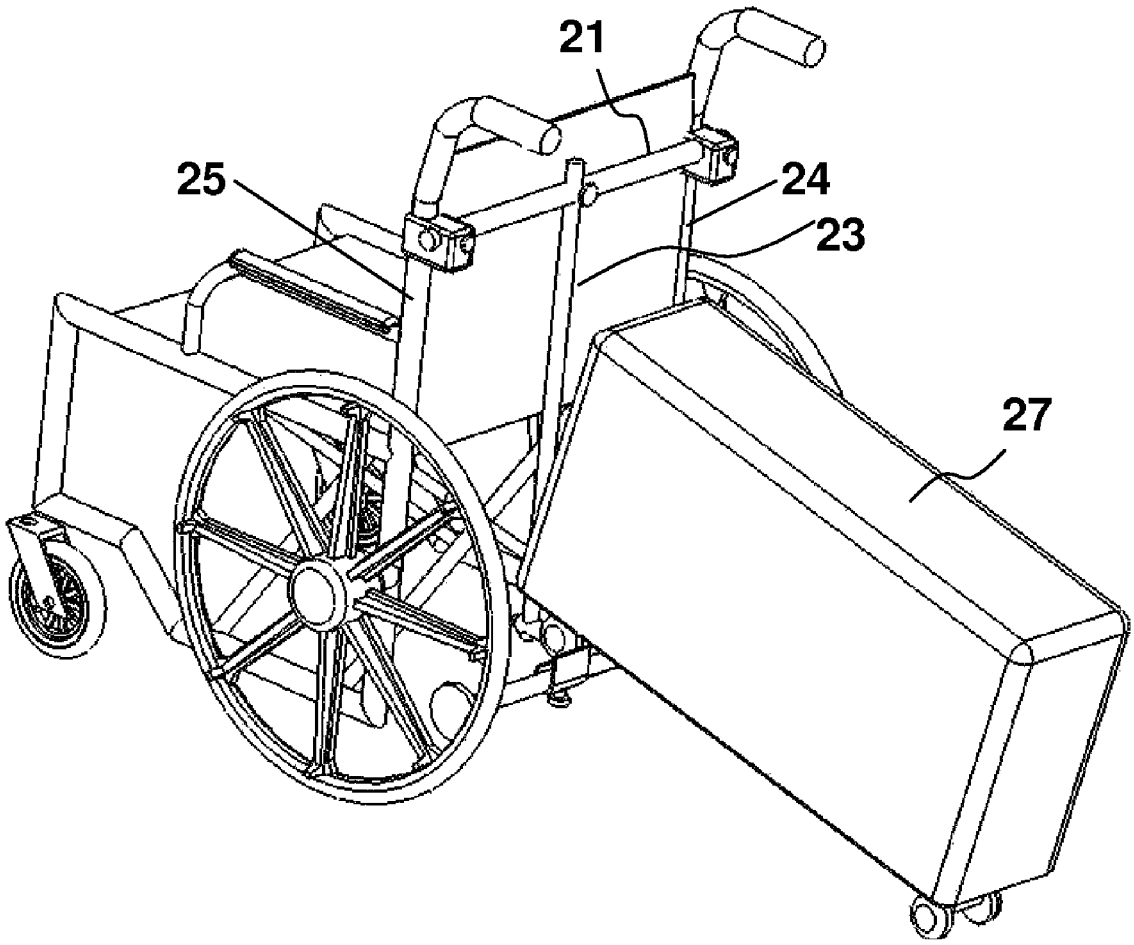
FIG. 5 A device for towing a luggage. The top horizontal bar is attached onto the already existing vertical bars, the attached vertical bar is adjusted low near the ground, and the wheeled suitcase is attached onto the lower horizontal bar.

Some wheelchairs do not have long enough vertical bars at their back and they may not even have a horizontal bar. The vertical bars in such wheelchairs do not extend low enough to attach a low lying horizontal bar. The present device is designed to be used with wheelchairs with short vertical bars as well. The device, shown in FIG. 4, comprises of a first horizontal bar 21 and a second horizontal bar 22 separated by an adjustable vertical bar 23. The first horizontal bar 21 having two sides 51*a* and 51*b*, which attache onto the wheelchair using two bar clamps 52*a* and 52*b* or similar attaching means. The first horizontal bar 21 attaches onto the existing vertical bars, 24 and 25 of a wheelchair as shown in FIG. 5. An adjustable vertical bar 23, having an upper 53 and a lower 54 ends, attaches to the horizontal bars by adjustable rod clamps 55 and 56. The vertical bar is adjusted so that the second horizontal bar locates close to the ground. The rod clamps allow moving of the vertical bar with respect to the first and the second horizontal bars.

Any rod clamp in which the bar can slide through or similar adjustable attaching means can be used.

A luggage 27 attaches onto the second horizontal bar, at the bottom end of the adjustable vertical bar as shown in FIG. 5. The second horizontal bar 22 has means to secure a luggage on the bar. Any means, such as two adjustable sockets 61 and 62 (as described earlier) can be used to set the luggage on. The wheels of the luggage fit on the sockets 61 and 62 of the horizontal bar or they can be locked or held by any other previously disclosed receiving means on the horizontal bar.

This device allows for greater stability of the wheelchair as the wheels of the suitcase touching the ground, act as a fifth point of contact (four wheels of the wheelchair and the wheels of the suitcase). It is also a very simple connecting means of the luggage to the wheelchair, as well as being convenient for the user.

Figure 6:
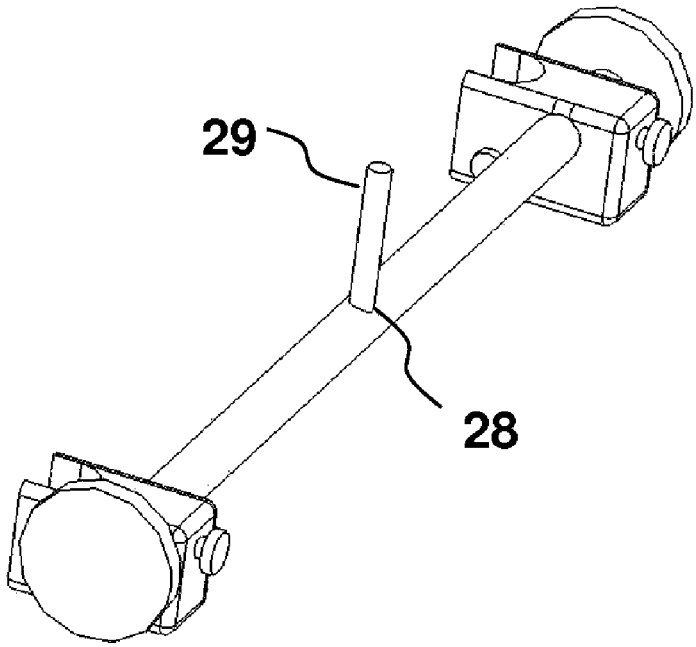
FIG. 6(*a*) A device for connecting the handle of a luggage to a wheelchair. A horizontal bar is attached between the two vertical bars at the back of the wheelchair. (*b*) Method of connecting the luggage to the wheelchair.
Figure 6:
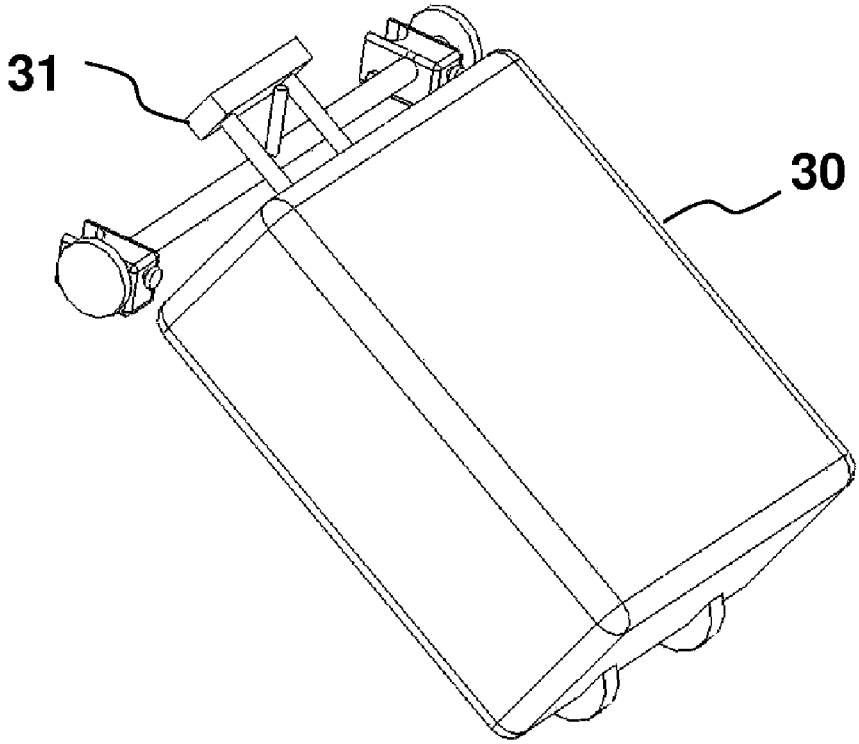
Figure 7:
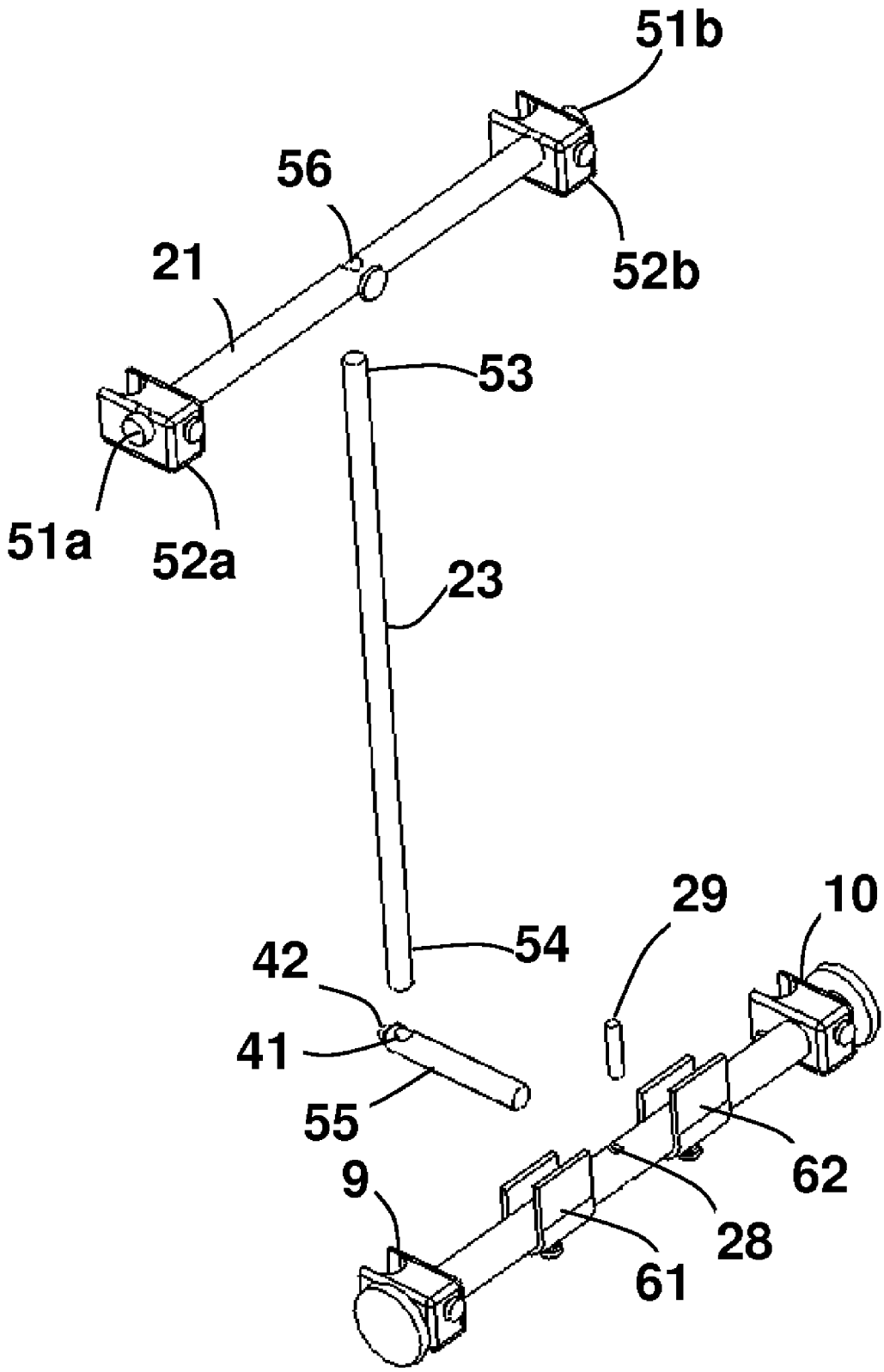
FIG. 7 A wheel chair towing device and its components.

The second horizontal bar 22 also includes an aperture 28 at its center, in which a small vertical rod 29 or a hook can be attached. If suitcase 30 has a handle 31 on its side (closest side to the wheelchair) then the handle can be connected to the wheelchair as shown in FIG. 6. FIG. 7 shows all the components of one embodiment of the present device. Various combination of these components can be used with different types of wheelchairs.

Some wheelchairs already have a horizontal bar between the vertical bars at the back, which is low enough to set the luggage on. In this case, the luggage can be directly set and secured onto this existing horizontal bar. If the suitcase does not have wheels, one of the above designs can be used to clamp a wheeled luggage carrier to the wheelchair.

Although certain embodiments of the techniques of the present application have been described, the spirit and scope of the application is by no means restricted to what is described above. Persons having ordinary skill in the art will be able to make variations, permutations, and combinations, in view of the above description, all of which are within the scope of the present application.

Attaching the Bars onto the Wheelchair

The horizontal or vertical or combination bars can be attached onto the wheelchair using any suitable clamping mechanism developed in prior art.

Attaching the Luggage onto the Bars

If suitcase has a handle on the side closest to the wheelchair, the handle could be clamped onto the wheelchair via appropriate clamping mechanism known to the skilled. Clamp can go through the suitcase handle and be attached to vertical bars or horizontal bar.

In another embodiment, clamps could attach onto top wheels of the suitcase (wheels closest to the wheelchair) by any suitable mechanism known to the skilled.

I claim:

1. A wheelchair luggage towing device for wheelchairs having two vertical bars at the back of the wheelchair, the device comprising:

a first horizontal bar having attaching means to attach to the vertical bars at the back of a wheelchair;

a vertically extended bar having an upper side and a lower side;

the upper side of said vertically extended bar adjustably attached to the first horizontal bar;

the lower side of said vertically extended bar adjustably attached to a second horizontal bar; and said second horizontal bar having multiplicity of luggage receiving means to securely receive a luggage, whereby said first horizontal bar attaches to the two vertical bars at the back of the wheelchair and said vertically extended bar attaches to the first horizontal bar at its upper end and to the second horizontal bar at its lower end, and the luggage sets on the second horizontal bar.

2. A device of claim 1, wherein said first horizontal bar further comprising multiplicity of luggage receiving means to securely receive a luggage, whereby said first horizontal bar horizontally attaches to the vertical bars at the back of a wheelchair which has long vertical bars to receive and carry a luggage.

3. A device of claim 1, wherein said upper side of said vertically extended bar having adjustable attaching means to attach said bar to a low lying horizontal bar on the back of a wheelchair.

4. A device of claim 1, wherein said luggage receiving means being sockets to securely receive the wheels of a wheeled luggage.

5. A device of claims 1, wherein said luggage receiving means being clamps to clamp a wheeled luggage carrier to the wheelchair, whereby an unwheeled luggage can be towed by setting the luggage on the luggage carrier.

6. A device of claim 1 wherein said luggage receiving means comprising of a rod or a hook vertically attached to the second horizontal bar, whereby the handle of a luggage can be hooked onto said rod or hook.

* * * * *